US006675815B1

(12) United States Patent
Hofstad

(10) Patent No.: US 6,675,815 B1
(45) Date of Patent: Jan. 13, 2004

(54) MULTI PURPOSE PERSONAL HYGIENIC DEVICE

(76) Inventor: Stein Hofstad, Strindveien 32, N-7052, Trondheim (NO)

( * ) Notice: Subject to any disclaimer, the term of this patent is extended or adjusted under 35 U.S.C. 154(b) by 0 days.

(21) Appl. No.: 09/980,805

(22) PCT Filed: Apr. 14, 2000

(86) PCT No.: PCT/NO00/00123

§ 371 (c)(1),
(2), (4) Date: Mar. 11, 2002

(87) PCT Pub. No.: WO00/62645

PCT Pub. Date: Oct. 26, 2000

(30) Foreign Application Priority Data

Apr. 19, 1999 (NR) ..... 19991855

(51) Int. Cl.[7] ..... A45D 44/18

(52) U.S. Cl. ..... 132/309; 132/311; 132/308; 206/5.1

(58) Field of Search ..... 132/309, 311, 132/310, 308, 314; 206/5.1, 38, 573, 37; 401/78, 71, 74, 80

(56) References Cited

U.S. PATENT DOCUMENTS 2,575,431 A * 11/1951 Smith ..... 132/309
2,599,019 A 6/1952 Rupert
2,601,244 A 6/1952 Boulicault
2,964,045 A * 12/1960 Otto et al. ..... 132/309
2,964,170 A * 12/1960 Otto et al. ..... 132/309
3,592,202 A * 7/1971 Jones ..... 132/309
4,429,786 A * 2/1984 Hucal ..... 206/5.1
4,542,828 A 9/1985 Gotto
5,002,179 A * 3/1991 Dhalla ..... 206/5.1
5,373,940 A * 12/1994 Hillelson ..... 206/385

FOREIGN PATENT DOCUMENTS

WO WO 97/05802 2/1997

* cited by examiner

*Primary Examiner*—Pedro Philogene
(74) *Attorney, Agent, or Firm*—Crompton, Seager & Tufte LLC

(57) ABSTRACT

A multifunctional article for personal hygiene, including a holder (2), a lid (4) and a cartridge (5). The holder (2) is hollow and is arranged to receive a tool section (3), such as a razor, toothbrush or similar. The tool section (3) is arranged to be covered by the lid (4) when not in use. The cartridge (5) is arranged to be inserted into the holder (2) and is attachable to an upper cap (16). The cartridge (5) is divided into at least one compartment (15) by radial and/or axial partition walls (14, 19). The lid (4) is provided with a lower cap (11) having a level end preferably with a diameter exceeding the largest diameter of the article so that it may be used to stand the article on end when not in use.

6 Claims, 9 Drawing Sheets

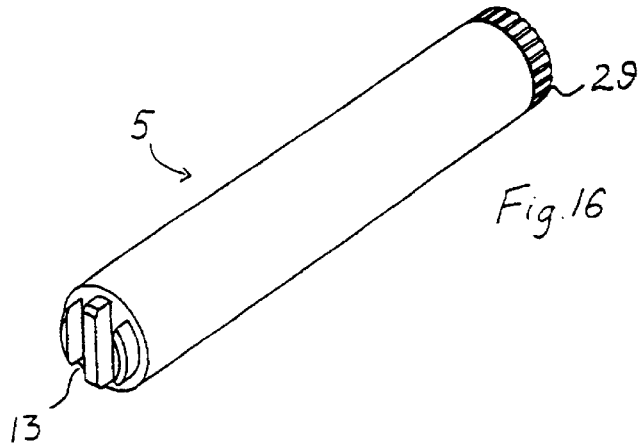
Fig. 16
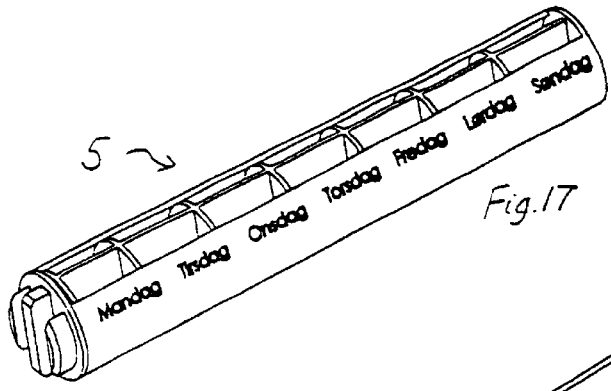
Fig. 17
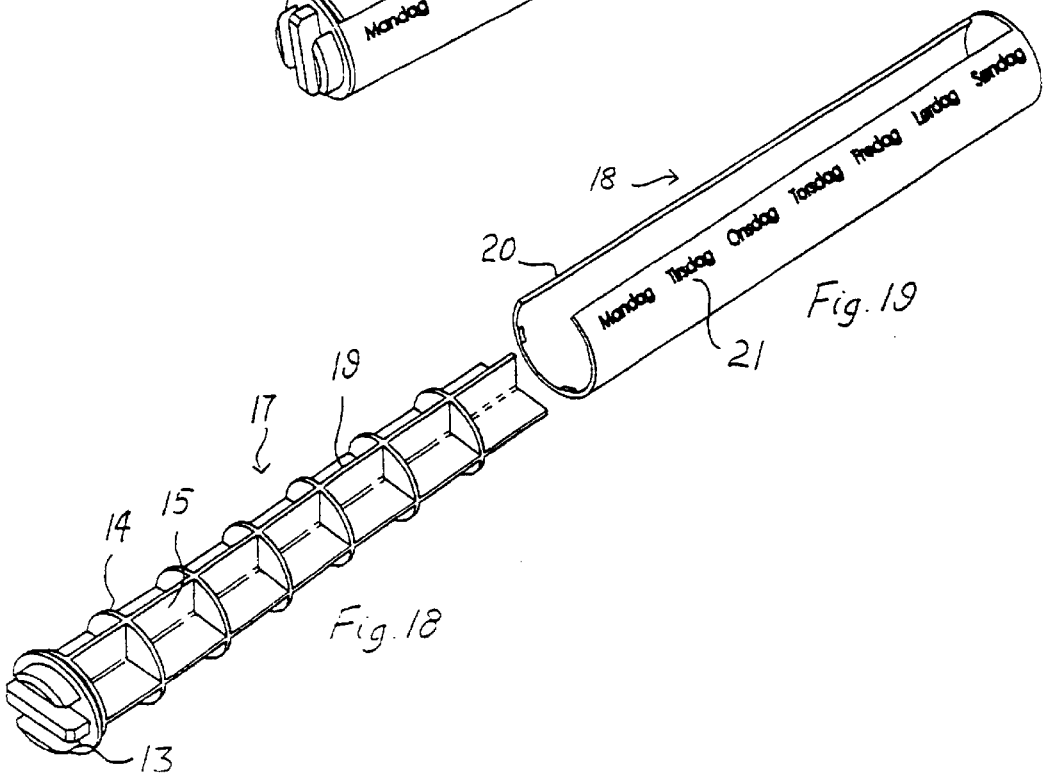
Fig. 19
Fig. 18

MULTI PURPOSE PERSONAL HYGIENIC DEVICE

The present invention relates to a multifunctional article for personal hygiene, according to the introduction of patent claim 1.

BACKGROUND

The miscellaneous articles necessary to attend to one's personal hygiene, such as toothbrush, razor, pill containers, toothpaste, shaving foam, etc., may together constitute a substantial volume. This is a particular disadvantage in connection with various kinds of travelling. Another familiar problem is that from time to time it can be difficult to remember to bring even the most necessary items.

In view of this the prior art discloses attempts to combine various articles for personal hygiene in order to decrease the total volume.

Accordingly the prior art describes collapsible toothbrushes, such as toothbrushes having a hollow grip usable as a lid when the toothbrush is not in use.

Moreover, there are known articles in which a toothbrush is combined with a razor in one single unit. This is disclosed in U.S. Pat. Nos. 5,622,195 and 4,542,828. However, in both of these articles the toothbrush and the razor are arranged at opposite ends of the article. Thus there is no mention of using the same grip for several utilities.

GB Patent Application No. 2 313 302 discloses a toothbrush having a hollow grip, in which dental floss and toothpicks are accommodated within the grip. U.S. Pat. No. 4,503,871 discloses a toothbrush having several compartments provided within the grip, wherein each compartment is adapted for accommodating a toothpaste package.

The prior art articles of combination articles for personal hygiene are constructed for one or more distinct purposes. Accordingly, they are not suitable for mutual combination. For that reason none of the prior art multifunctional articles for personal hygiene can attend to a general or total need within this technical field.

Object

The main object of the present invention is to provide a multifunctional article for personal hygiene which substantially meets the total basic need within this field or at least provides the public with a useful choice.

Object

The main object of the present invention is to provide a multifunctional article for personal hygiene which substantially meets the total basic need within this field or at least provides the public with a useful choice.

THE INVENTION

The object above is achieved with an article having features described in the characterizing section of claim 1. Further features appear from the respective independent claims.

EXAMPLES OF EMBODIMENTS

In the following the invention is described in further detail in view of examples of embodiments and with reference to the accompanying drawings, in which FIG. 1 illustrates an exploded view of an article according to the present invention, FIG. 2 is a perspective drawing illustrating a side view of the container section included in the present invention, FIG. 3 is a perspective drawing of a toothbrush section included in one embodiment of the present invention, FIG. 4 is a perspective drawing of a razor section included in one embodiment of the present invention, FIGS. 5 and 6 are perspective drawings of the lid section included in one embodiment of the present invention, FIGS. 7 and 8 are perspective drawings of a lid included in the lid section in FIGS. 5 and 6, viewed from outside and from inside, respectively, FIGS. 9 and 10 illustrates, in perspective, the lid section of FIGS. 5 and 6 having a container section viewed from below and from above respectively, FIG. 11 is a perspective drawing of the lid section of FIGS. 5–6 having a figurine attached to its end, FIG. 12 is a perspective drawing of a figurine attached to the end of the holder section, FIG. 13 is a perspective drawing of a first embodiment of a cartridge section included with the present invention, FIG. 14 is a perspective drawing of a second embodiment of a cartridge section included with the present invention, FIG. 15 is a perspective drawing of a third embodiment of a cartridge section included with the present invention, FIG. 16 is a perspective drawing of a fourth embodiment of a cartridge section included with by the present invention, FIG. 17 illustrates in perspective a fifth embodiment of a cartridge section included with the present invention, FIG. 18 illustrates in perspective the housing comprised by the cartridge section of FIG. 17, FIG. 19 illustrates in perspective the partition wall section included in the cartridge section of FIG. 17, FIG. 20 illustrates in perspective a sixth embodiment of a cartridge section included with the present invention, FIG. 21 is a perspective drawing illustrating a seventh embodiment of a cartridge included with the present invention, FIG. 22 is a perspective drawing illustrating an eighth embodiment of a cartridge section included with the present invention in the form of an insulin syringe, FIG. 23 illustrates in perspective an upper lid comprised by the present invention viewed from above, and FIG. 24 is a perspective drawing of the lid of FIG. 10, viewed from below.

With reference to FIG. 1, a multifunctional article for personal hygiene in accordance with the present invention is illustrated and generally denoted by reference numeral 1. The article 1 comprises a holder 2, a tool section 3, a lid 4 and a cartridge 5. In the present embodiment the tool section 3 is illustrated in the form of a toothbrush 3.

The holder 2, also illustrated in FIG. 2, exhibits a hollow interior and its exterior is provided with upper and lower rings 6 and 7, respectively. The shape of the holder is substantially cylindrical, whereby its diameter is smaller at the middle increasing in the direction of the rings 6 and 7, respectively. Upper and lower rings 6 and 7 are in part provided for aesthetic purposes and to provide an improved grip about the holder 2.

The toothbrush 3, illustrated in further detail in FIG. 3, comprises a brush head 8 and a brush body 9, the brush body being substantially conically shaped and arranged with its smallest diameter at the brush head end. Moreover, the brush body is preferentially provided with a hollow interior to match and locate in an interference fit with a conically shaped section 10 of said holder 2. In future embodiments the brush body 9 could be attached to the holder 2 with alternative attachment means.

FIG. 4 illustrates a razor 24 which may comprise the tool section 3. The razor also exhibits a body 9 attachable to the holder 2.

FIGS. 5 and 6 illustrate, in perspective, the lid 4 viewed from below and from above, respectively. The lid 4 exhibits in part a cylindrical shape and in part a conical shape, the thickest part provided at the lower part of the lid 4 toward a cap 11. The interior of the lid 4 is hollow and is intended to encompass said toothbrush 3 and attachment to the holder section 2. The lid comprises a cap 11. FIGS. 7 and 8 show the cap 11 viewed from the outside and from the inside, respectively. The cap 11 is provided with a central projection 12 in such a way that the lower cap 11 fits with the lid 4. The cap 11 is provided with internal threads 31. Thus, accessories can releasably be attached to the lower end of said article 1.

The lower cap 11 exhibits a level lower end, and has a diameter exceeding the average diameter of the article as a whole. Preferably, the lower end of the lower cap 11 exhibits a diameter exceeding the largest diameter of all components above the lower cap 11. This embodiment provides a sufficiently large area to allow the article 1 to rest upon the level end of said lower cap 11 when not in use.

In order to avoid the formation of bacteria, the lid 4 is preferably provided with some sort of ventilation means, which in the figures is illustrated as a bore or vent 25 with an accompanying groove 26. The vent 25 is provided in the lower wall of the lower cap 11, the groove 26 extending in the bottom surface from the vent 25 and to the periphery of the lid. In this way the tool section 3 in the lid 4 is aired when the article rests upon the lower cap 11.

FIGS. 9 and 10 illustrate the lid section 4 attached to a container section 27 viewed from below and from above, respectively. The container section 27 can, for example, contain toothpaste, shaving foam, hair style foam or other required products. In the case of shaving foam, spare razor blades can beneficially be contained within the bottom of the container section (not illustrated).

FIG. 11 shows a lid section 2 having a novelty figurine 28 attached to its end. This is particularly relevant if the article 1 is intended for use by children. As illustrated in FIG. 12, figurines 28 can also be attached to the end of the container section 2.

The cartridge 5 is illustrated in greater detail in FIG. 13. The cartridge 5 is provided with an upper groove 13. Moreover the cartridge is provided with partition walls 14 which therebetween form storage space 15. The cartridge 5 is adapted to fit within the interior of the hollow container 2. An upper cap 16 (not illustrated in FIG. 13) is arranged to fit into the groove 13 on the cartridge 5 in such a manner that cartridge 5 and upper cap 16 can rotate in relation to the container 2. This is described in further detail below.

FIGS. 14, 15 and 16 illustrate alternative embodiments of the cartridge 5 with varying numbers of partition walls 14. In FIG. 16, the cartridge 5 is formed as a tube having a cover or lid 29.

FIGS. 17, 18 and 19 show yet a further embodiment of the cartridge 5. This embodiment comprises a partition wall section 17 (illustrated in FIG. 18), and a casing section 18, illustrated in FIG. 19. The partition wall section 17 is essentially equivalent to the cartridge section 5 as a whole, as illustrated in FIG. 13. The difference is that the diameter of the partition wall 17 is somewhat smaller to allow accomodation within the casing section 18, the latter also being able to be accomodated within the holder 2.

The partition wall section 17 comprises radially extending partition walls 14 and axially extending partition walls 19. The axially extending partition walls 19 (of which two are illustrated in the Figure) divides each chamber or compartment between the radially extending partition walls 14 into four sections.

The casing section 18 is formed as a cylindrical casing having an axially extending notch 20. FIG. 17 illustrates an additional example of labeling of the casing 18 with the weekdays 21.

When the casing section 18 is in place on the outside of the partition wall section 17, the notch 20 will permit access to one of the compartment rows 15 of the partition wall section 17. The individual compartments may be utilised for, e.g., pills, and the user can select the proper pill for the weekday in question. This cartridge embodiment permits four pill compartments for each weekday. The partition wall section 17 is rotated in relation to the casing section 18 by gripping the upper cap 16 engaging the groove 13 in the partition wall 17. In this way a sequential access to the compartments 15 is obtained.

Figure 23:
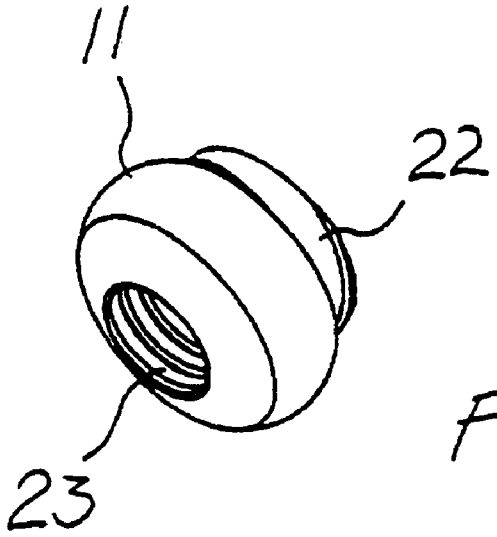
Figure 24:
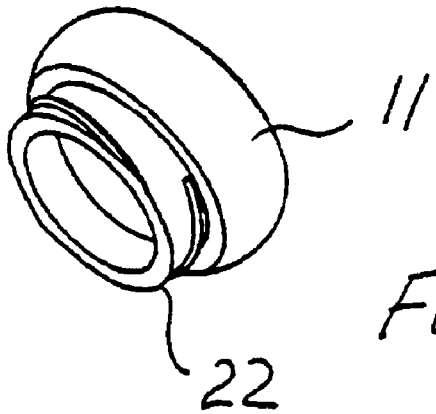

An upper cap 16 is shown in FIGS. 23 and 24, the cap being provided with external threads 22 allowing the cap to be screwed onto the lid 4. Moreover, the cap 16 is provided with internal threads 23 adapted to receive miscellaneous accessories, such as packages of toothpaste, shaving foam and similar, the accessories being provided with corresponding threads.

The toothbrush 3 is an example of a tool section which may be included with an embodiment of the present invention. Other similar tool sections, such as razors, should be obvious in view of the description above, and are also regarded as included with the present invention. The razor head is preferably foldable, wherein the head is oriented perpendicular to the grip axis in a state ready for use. When the razor is not in use, the head can be folded downwards to the grip, thus allowing accomodation within the lid 4.

Figure 1:
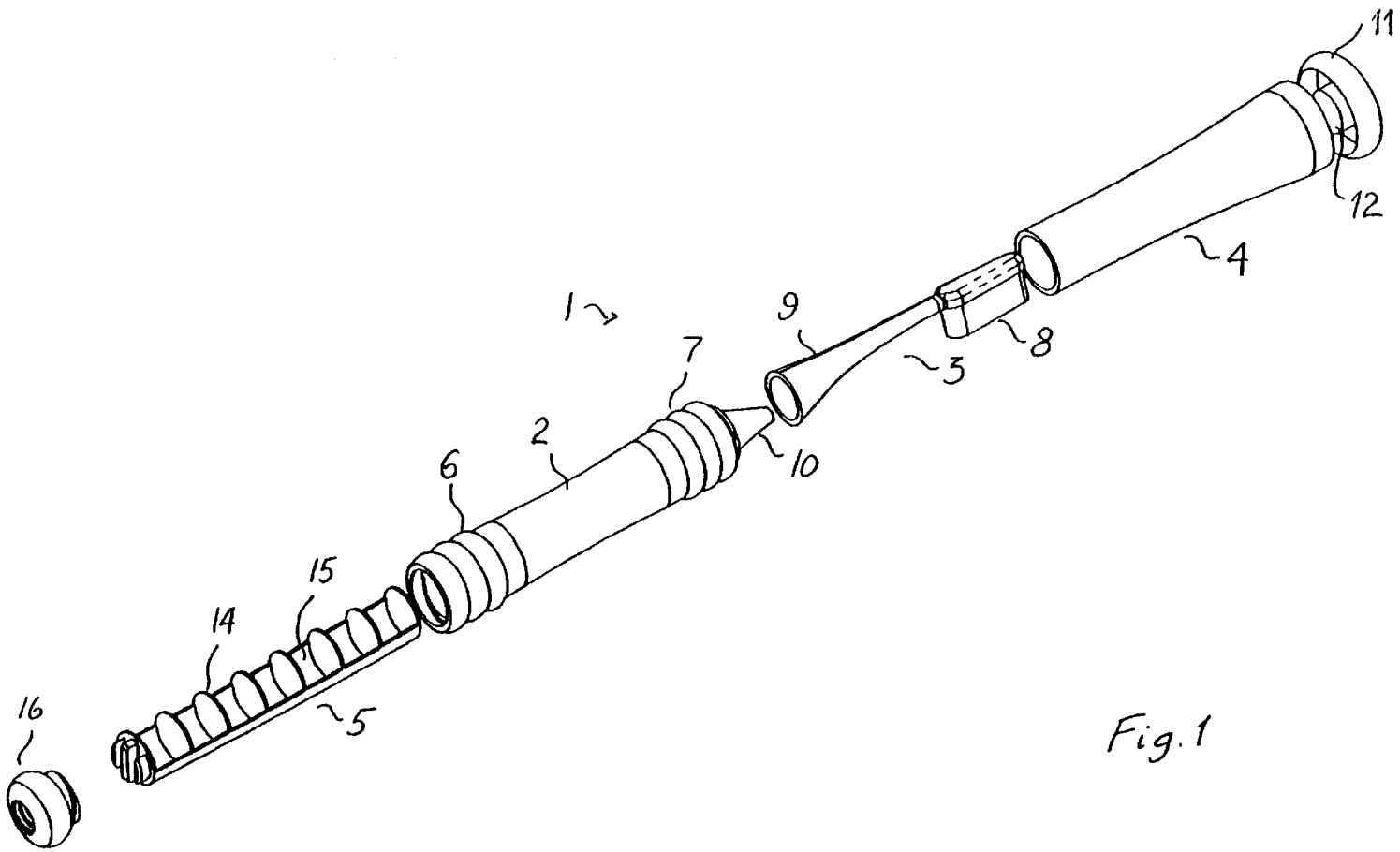
Figure 2:
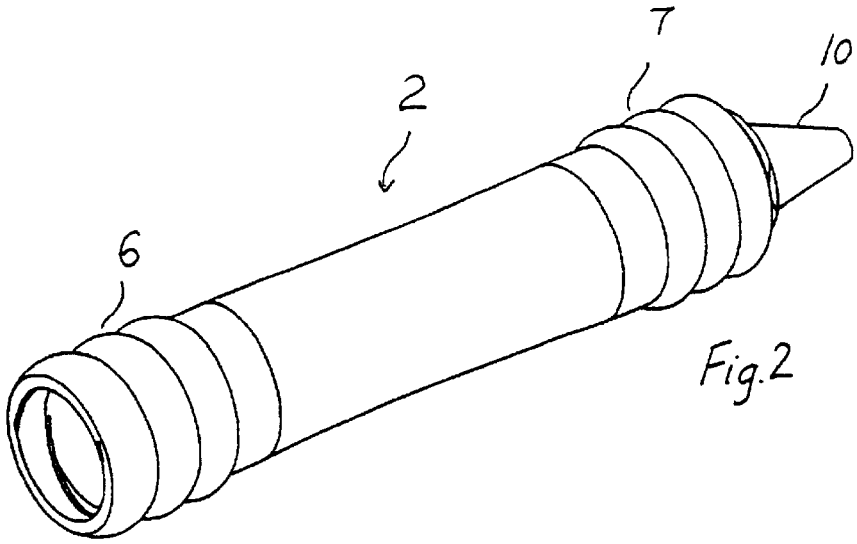
Figure 3:
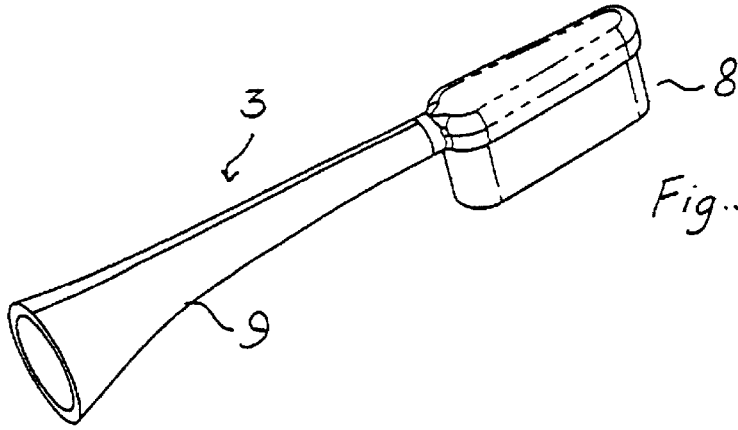
Figure 4:
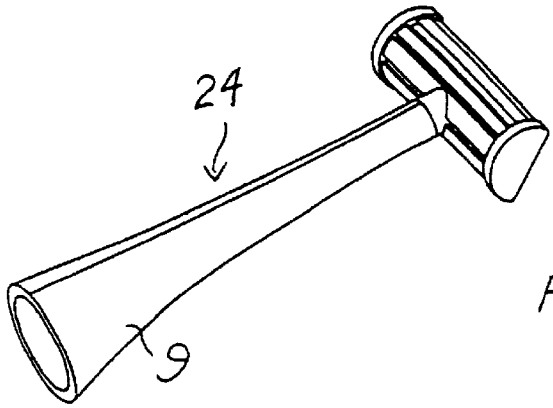
Figure 5:
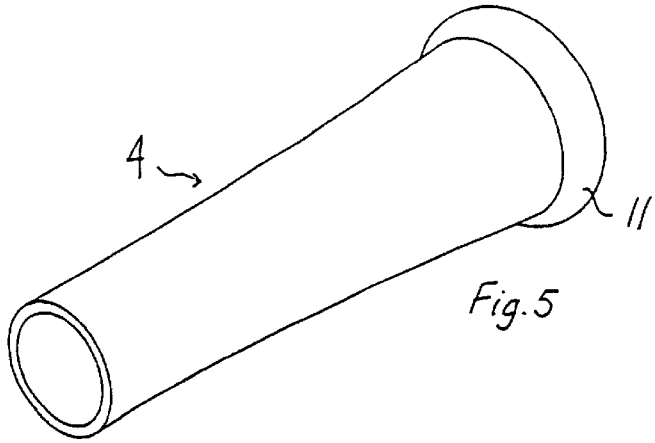
Figure 6:
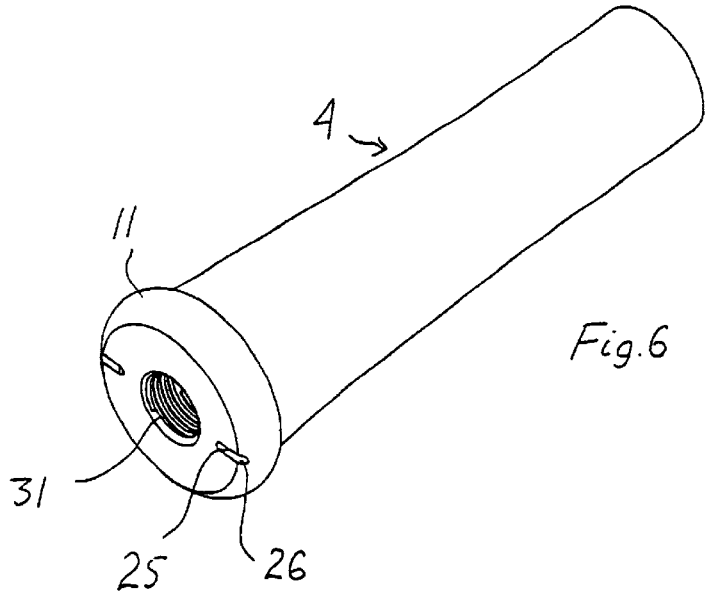
Figure 7:
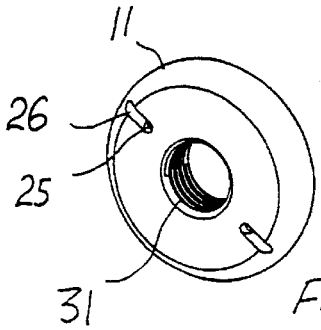
Figure 8:
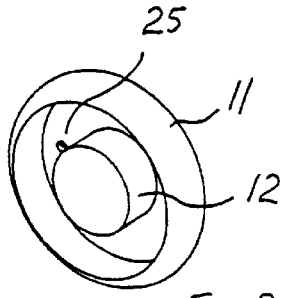
Figure 9:
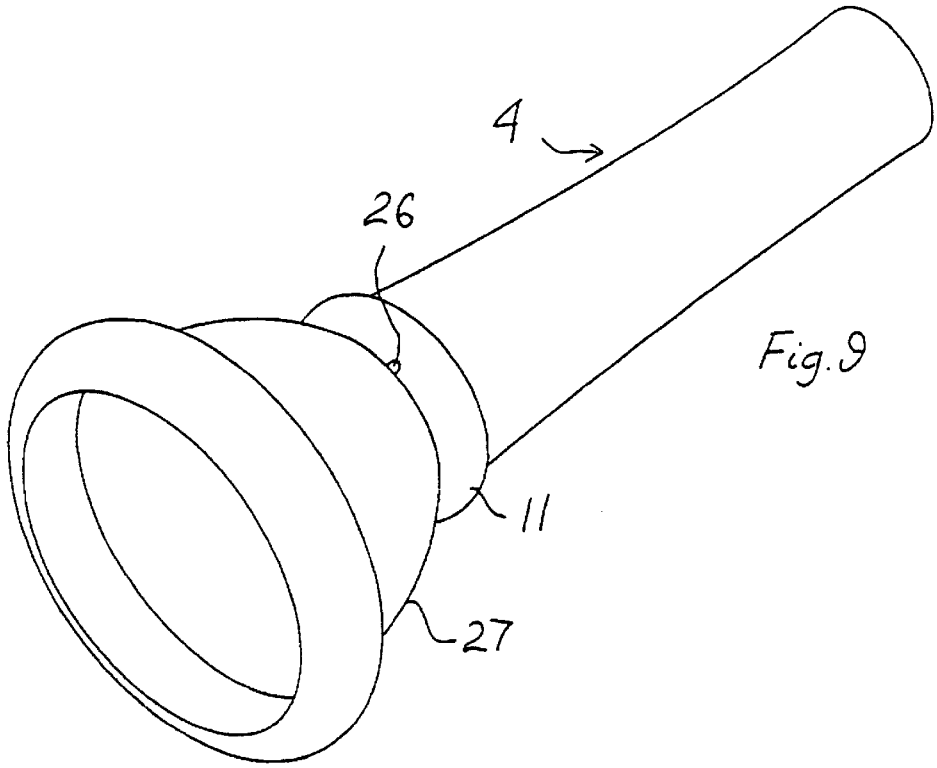
Figure 10:
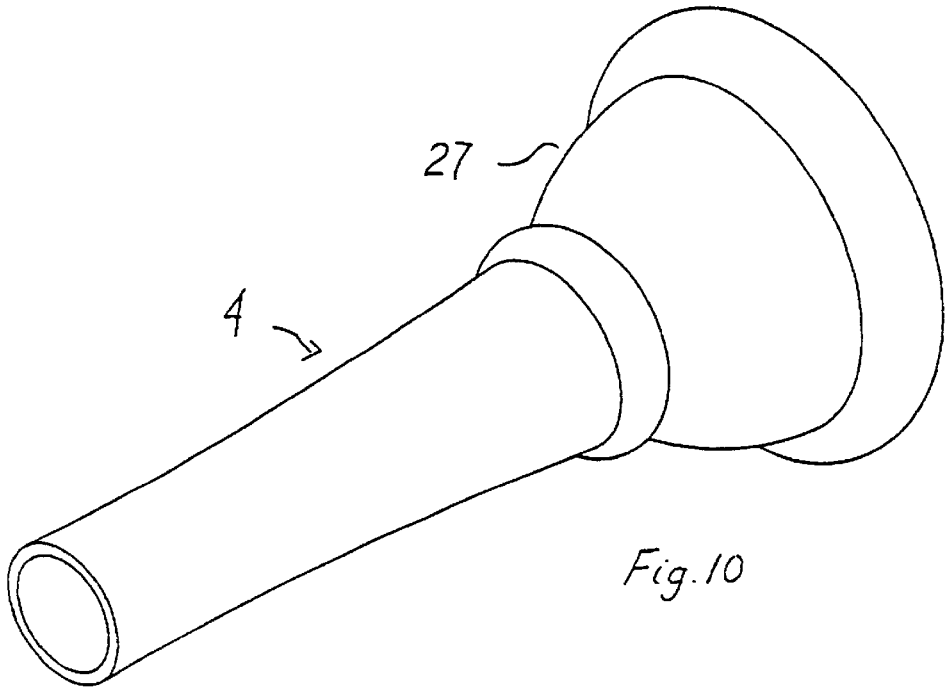
Figure 11:
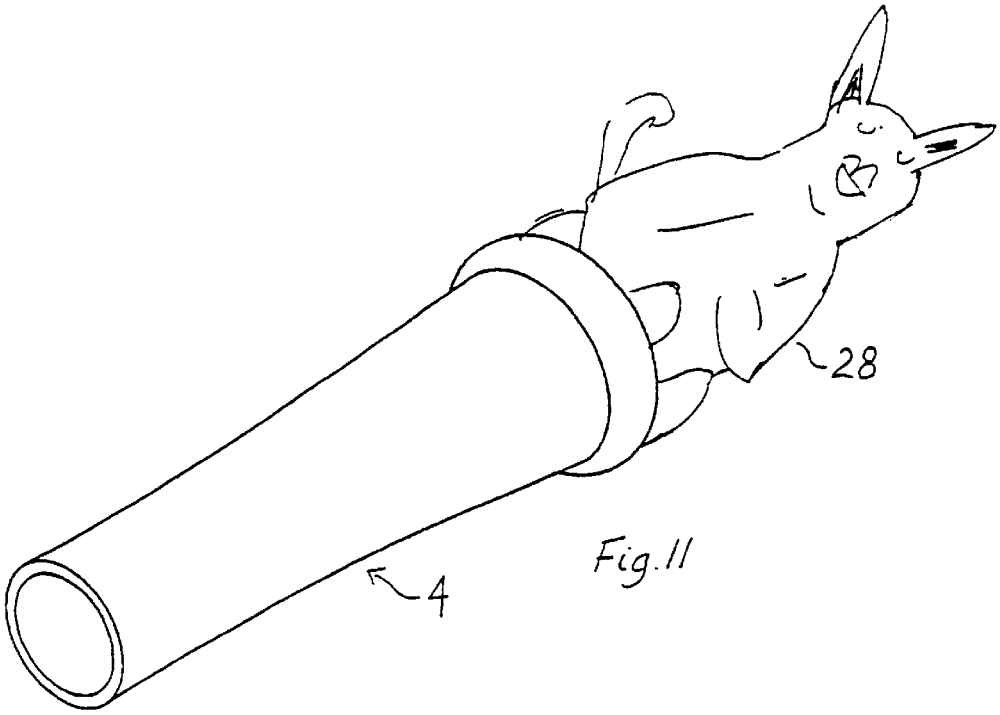
Figure 12:
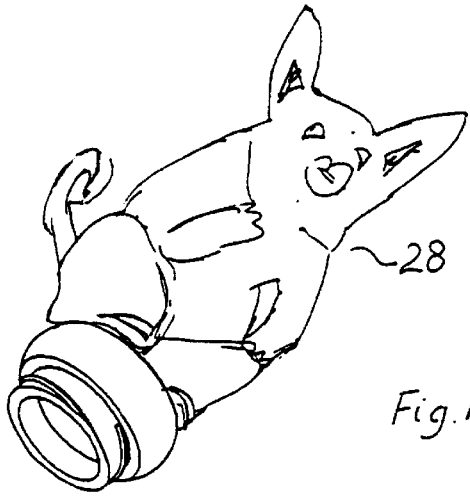
Figure 13:
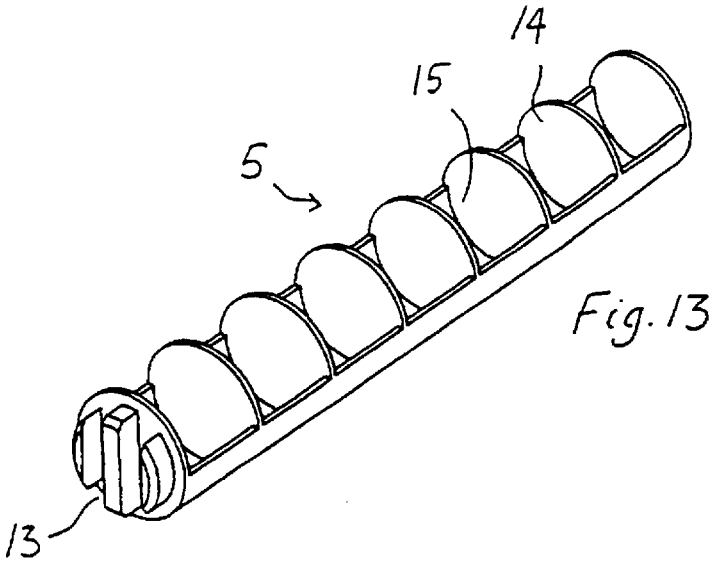
Figure 14:
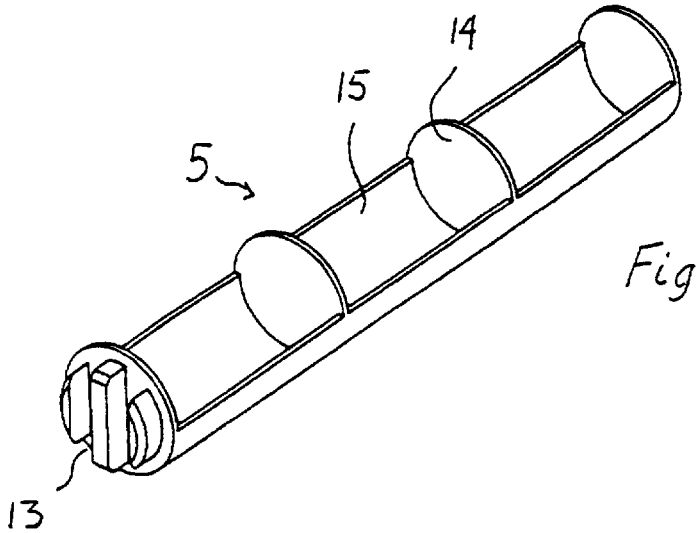
Figure 15:
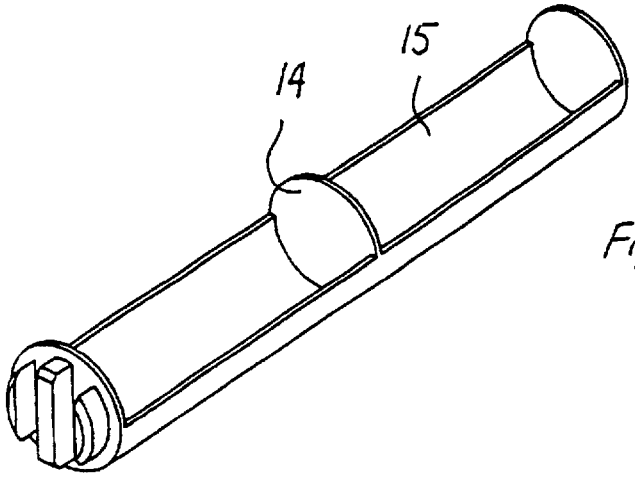
Figure 20:
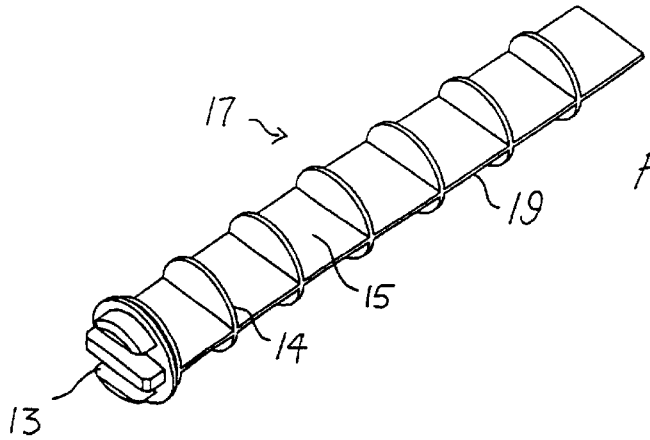
FIGS. 20 and 21 illustrate further embodiments of the partition wall section 17.
Figure 21:
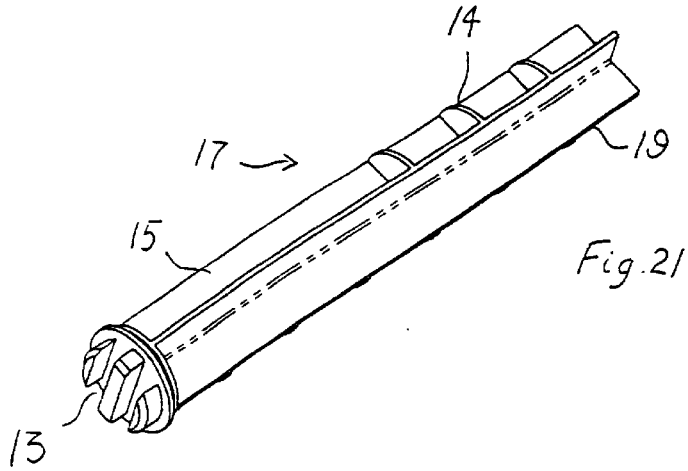
Figure 22:
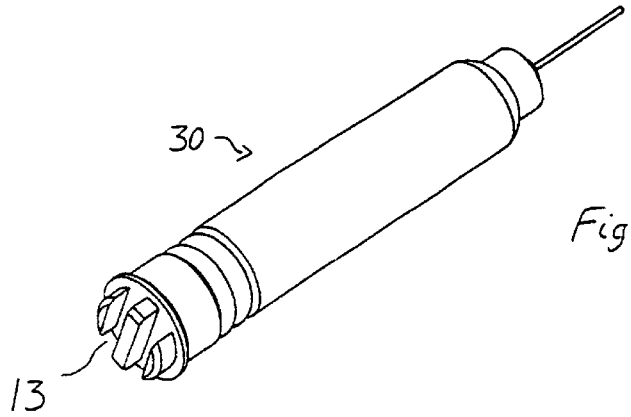
FIG. 22 illustrates a cartridge section 5 formed as an insulin syringe 30.

The cartridge section 5 can be formed by various methods. Firstly, it is possible to employ the total compartment volume for accomodation of miscelleaneous articles. Examples of relevant articles are: insuline syringes, Q-tips, make-up articles, etc. Moreover, the total volume can be divided axially (as shown in FIG. 13) and/or radially. FIG. 17 illustrates both axial and radial division. In an embodiment having only axial division (not illustrated), the separate compartments can be employed for, e.g., Q-tips, toothpicks, simple sewing things, and other trifles available as a matter of handiness.

The article in accordance with the present invention can be shaped in various manners, with regard to shape, construction material as well as color and decoration. Both the lid 4 and the holder 2 can be partially transparent, but in most cases the holder 2 is desirably not transparent. The surfaces of the holder 2 and the lid 4 can alternatively be provided with miscellaneous kinds of decorations, such as advertisements for products and services. Accordingly, the article in accordance with the present invention can be utilised in connection with public relations.

What is claimed is:

1. A multifunctional article for personal hygiene, comprising:

a generally cylindrical holder, a generally cylindrical lid, said holder having a hollow interior and being configured to receive a tool section provided with a first upper cap, the lid being hollow and provided with a second lower cap, the tool section being arranged to be covered by the lid when not in use;

wherein the second cap includes a substantially level end exhibiting a diameter exceeding the average diameter of the article as a whole, and/or exceeding the largest diameter of all components adjoining the second cap;

the first cap being provided with threads to receive miscellaneous accessories;

the second cap being provided with threads to receive miscellaneous accessories; and a cartridge element configured for insertion into the holder and being fastened by the first upper cap, the cartridge element is divided into one or more compartments.

2. The article in accordance with claim 1, wherein the cartridge element is divided into several compartments by radially and/or axially extending partition walls.

3. The article in accordance with claim 1, wherein a bore or vent is provided in the lid to ventilate the tool section when not in use.

4. The article in accordance with claim 3, wherein the bore is provided in the second cap, and a groove is extending from the bore to the periphery of the cap.

5. The article in accordance with claim 1, wherein the cartridge comprises a partition wall section and a casing section, whereby said partition wall section fits within the casing section and the casing section fits within the holder.

6. The article in accordance with claim 5, wherein the casing section is cylindrical and is provided with an axially extending notch.

* * * * *